United States Patent [19]

Braedle et al.

[11] Patent Number: 5,060,570

[45] Date of Patent: Oct. 29, 1991

[54] FLEXOGRAPHIC PRINTING MACHINE HAVING COMMON CONTROL MEANS FOR RAPID APPROACH AND DISENGAGEMENT OF CYLINDERS

[75] Inventors: Gilbert Braedle, Ringendorf; Paul Cromer, Stotzheim; Francis Huck, Rosenwiller, all of France

[73] Assignee: H. I. Holweg International S. A., Rosheim, France

[21] Appl. No.: 415,773

[22] Filed: Oct. 2, 1989

[30] Foreign Application Priority Data

Oct. 4, 1988 [FR] France ..... 88 13243

[51] Int. Cl.[5] ..... B41F 5/24

[52] U.S. Cl. ..... 101/247; 101/352

[58] Field of Search ..... 101/352, 351, 350, 363, 101/364, 247

[56] References Cited

U.S. PATENT DOCUMENTS

| | | | |
|---|---|---|---|
| 3,041,967 | 7/1962 | Nystrand | 101/247 X |
| 3,635,160 | 1/1972 | Specht et al. | 101/352 X |
| 3,791,294 | 2/1974 | Skelding et al. | 101/352 X |
| 4,309,945 | 1/1982 | Marion | 101/351 X |
| 4,413,560 | 11/1983 | Rogge | 101/352 X |

FOREIGN PATENT DOCUMENTS

| | | | |
|---|---|---|---|
| 1361170 | 4/1964 | France | 101/351 |

*Primary Examiner*—Clifford D. Crowder

*Attorney, Agent, or Firm*—Sandler, Greenblum & Bernstein

[57] ABSTRACT

A printing unit for a flexographic printing machine having an individual or sole impression cylinder (10) comprises a plate cylinder (9) and an inking cylinder (11) slidably mounted by means fo supports (16, 25) on a bed (2). In order to facilitate the displacement and the positioning of the cylinders (9, 10, 11) with respect to each other, it is provided for the supports (16 , 25), arranged on one and the same side of the longitudinal central plane of the continuous material to be printed, to be mounted on one and the same guide shaft (17) which is integral with the bed (2) and to ensure their displacement with the aid of common control means (36) for rapid approach and disengagement in order to obtain the engagement and the disengagement of the cylinders (9, 10, 11) with respect to one another.

20 Claims, 5 Drawing Sheets

FLEXOGRAPHIC PRINTING MACHINE HAVING COMMON CONTROL MEANS FOR RAPID APPROACH AND DISENGAGEMENT OF CYLINDERS

BACKGROUND OF THE INVENTION

1. Field of the Invention

The invention relates to a printing unit for a flexographic printing machine having an individual or sole impression cylinder, comprising a plate cylinder which is movably mounted by means of supports on the bed of the flexographic printing machine, and an inking cylinder which is combined with an inking device integral with the support which slides with respect to the said bed and pre-positioning devices and fine adjustment means for positioning the different cylinders precisely with respect to one another.

2. Description of Background and Relevant Material

The present invention relates to the field of printing and, more particularly, to the manufacturing of printing units, notably, flexographic printing machines.

The flexographic printing machines are intended more particularly for printing materials in continuous strip form such as paper, cellulose film, aluminium, plastic materials. To this effect they have one or several printing units, the number depending upon the successive coats which are conveniently applied to the strip in order to reproduce faithfully the composition of the colours which make up the text or the image to be printed.

The flexographic printing machines also have a bed on which the different printing units are distributed. The printing machines have a plate cylinder on which the printing plates are mounted and an inking cylinder which is generally screened and intended to apply a predetermined quantity of ink from any sort of inking device to the plate cylinder. It also co-operates with an impression cylinder which is partially enwrapped by the strip.

The flexographic printing machine is referred to as having individual impression cylinders when, for each printing unit, it has such an impression cylinder cooperating with a plate cylinder. It is referred to as having a sole impression cylinder when the latter is arranged in the center of the structure, the printing units being distributed around it.

The quality of the printing depends essentially upon the precise positioning of one of the cylinders forming the printing unit with respect to another which is adjacent to it.

Thus, the positioning of the inking cylinder must be adjusted to the arrangement of the plate cylinder, which is itself determined with respect to the position of the impression cylinder on the bed. However, a flexographic printing machine is intended to print continuous strips according to a variable format, the diameter of the plate cylinder depending directly upon this format. For this reason the plate cylinder cannot occupy a fixed position on the bed of the machine. In the same way, the thickness of the support, in particular of the strip, depends upon the material used. For this reason, it is necessary to be able to modify the position of the plate cylinder with respect to the impression cylinder.

In addition, according to a known arrangement, the plate cylinder is associated with a movable support which is mounted so that it slides on plane rectilinear slides provided on the bed of the flexographic printing machine. As to the inking cylinder and the associated inking device, these are suspended from a runner mounted on slides equivalent to those referred to above and provided on the movable support of the plate cylinder.

For this reason it is possible through the intermediary of manual or automatic drive means to proceed on the one hand to displace the plate cylinder with respect to the impression cylinder fixed on the bed and, on the other hand, to obtain a relative displacement of the inking cylinder with respect to the said plate cylinder.

Given that the printing quality depends upon the precision in positioning the different cylinders which constitute a printing unit, initially a pre-positioning device is called for which permits approach or rapid disengagement of the plate support on the bed of the flexographic printing machine and of the runner, equipped with the inking cylinder, with respect to the said plate support. At the same time, a printing unit has fine adjustment means, with manual or motorized control which makes it possible to position the plate cylinder exactly with respect to the impression cylinder and the inking cylinder with respect to the plate cylinder. The disadvantages of the known printing units when applied to current flexographic printing machines reside essentially in their complexity, particularly at the level of the means which influence the movability of the different cylinders with respect to one another.

It will be noted initially that the design of the plane rectilinear slides provided on the bed and receiving the plate support and, favoring the displacement of the runner equipped with the inking cylinder, is particularly delicate. In fact, the plane rectilinear slides necessitate, in addition to a milling operation, a trueing phase followed by manual scraping of the surface. This results in a considerable machining time necessitating a manual phase which consequently increases the manufacturing cost of the flexographic printing machine.

It should also be noted that both the pre-positioning devices and the fine adjustment means require separate driving means depending upon whether it is the plate support or the runner equipped with the inking cylinder which is to be moved. This mechanical complexity merely amplifies the preceding consequences.

Other disadvantages of the known printing units reside in the means used, on the one hand, to proceed to the momentary disengagement of the different cylinders from one another in the case of temporary stoppage of printing and, on the other hand, to ensure their return into the printing position without having to use the fine adjustment means.

Very frequently, electrical or electronic devices are, called for which make it possible to locate and memorize the printing position of the plate cylinder and of the inking cylinder. Thus in the event of disengagement of these two cylinders from one another, controlled by manual or automatic driving means, the electronic or electrical locating means facilitate the task of the operator in bringing the different cylinders quickly into the printing position or are capable of actuating and controlling the functioning of the automatic driving means so as to guarantee a systematic and precise return of the cylinders into their engaged position.

Such a solution contributes to the complexity of the assembly and imposes the use of a more sophisticated material. In fact, these electrical or electronic locating means are only effective in circumstances where they are associated with automatic and not manual driving means. In order to guarantee precision in the positioning either of the plate cylinder with respect to the impression cylinder or of the inking cylinder with respect to the said plate cylinder, it is necessary for the electronic information communicated by the located device to be translated accurately by the driving means into a well-defined length of displacement either of the plate support or of the runner equipped with the inking cylinder. This accuracy can only be achieved by using relatively burdensome servo motors.

SUMMARY OF THE INVENTION

The object of the present invention is to remedy all of the aforementioned disadvantages by proposing a printing unit in which the driving means of the pre-positioning device are identical for the plate cylinder and the inking cylinder. Furthermore, this printing unit has mechanical means for memorizing the printing position of the different cylinders which are able to disregard any play between the mechanical connections and which, in addition, are capable of limiting the amplitude of the disengagement of the cylinders from one another in the event of temporary stoppage of printing. Such mechanical memorisation means also avoid the use of complex and costly driving means such as servo motors.

This invention, which solves the problems discussed above, for a flexographic printing machine having an individual or sole impression cylinder comprises a plate cylinder which is mounted by means of supports so as to be movable on the bed of the said flexographic printing machine, an inking cylinder combined with an inking device and integral with supports which slide on the said bed and pre-positioning devices and fine adjustment means for precise positioning of the different cylinders with respect to one another, the supports which are arranged on one side of the longitudinal central plane of the material in continuous strip form to be printed, of the plate cylinder and of the inking cylinder being mounted so as to slide on one and the same guide shaft which is integral with the bed and being actuated through the intermediary of common control means for approach and rapid disengagement in order to ensure the engagement or disengagement of the cylinders with respect to one another.

The invention is explained below in greater detail with the aid of drawings showing only one embodiment.

Figure 1:
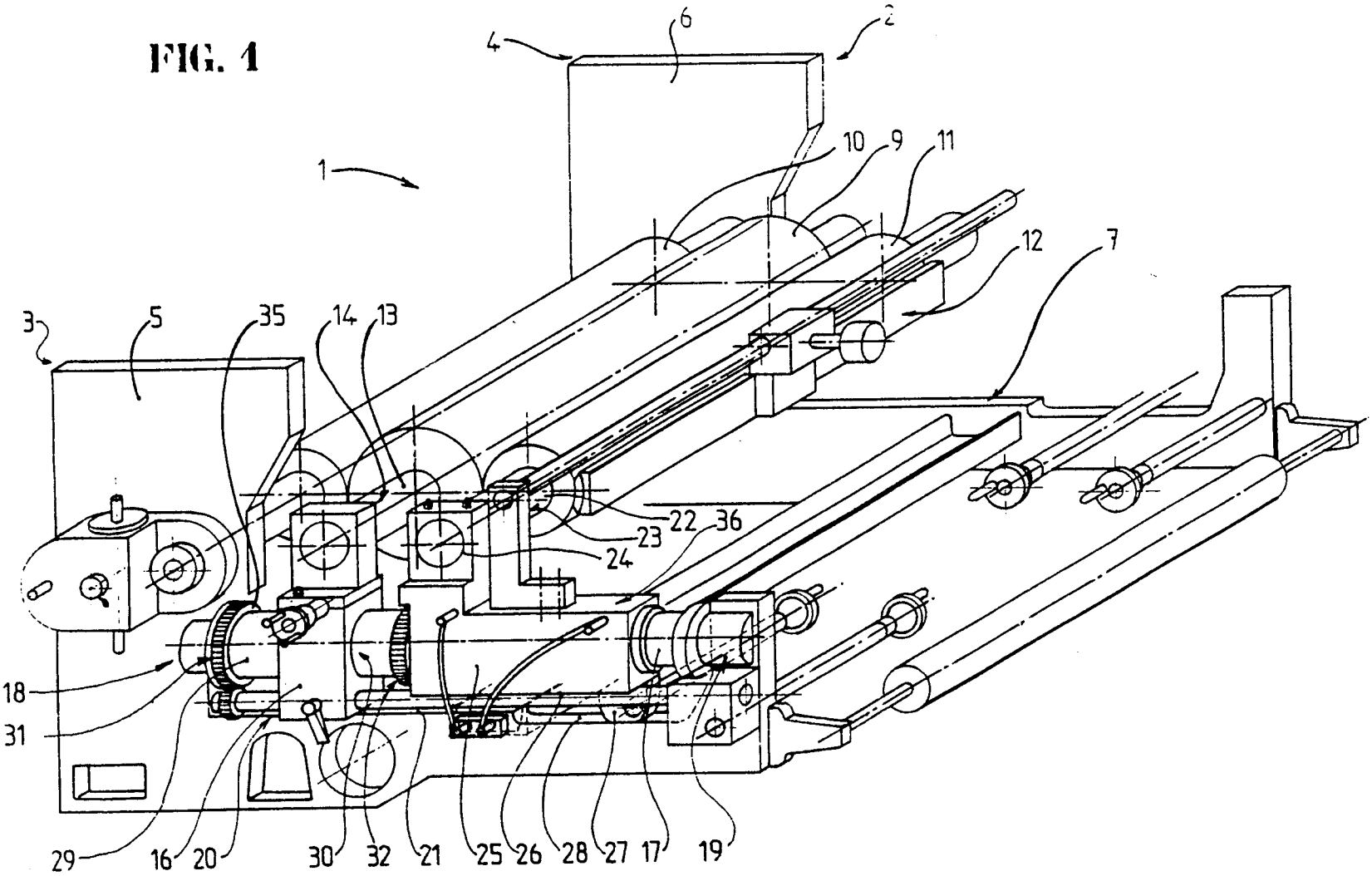
FIG. 1 shows a partially schematic perspective view of a printing unit according to the present invention.

Reference will be made more precisely to FIG. 1.

The present invention relates more particularly to a printing unit 1 for a flexographic printing machine intended to print material in continuous strip form such as paper, cellulose film, aluminium plastic or other materials.

In a general way, a flexographic printing machine has a bed 2 consisting of a front wall 3 and a rear wall 4 arranged on either side of the longitudinal central plane of the material in continuous strip form which is to be printed. On this bed 2 are distributed one or more printing units 1, the number thereof depending more precisely on the number of successive coats which should be applied to the continuous material. Thus there are in existence flexographic printing machines having two, four or six printing units generally distributed symmetrically with respect to the vertical central plane, transversely with respect to the longitudinal axis of the strip.

A flexographic printing machine is referred to as having a sole impression cylinder when it has in the centre of its bed 2 one sole impression cylinder around which the different printing units 1 are distributed. By contrast, the flexographic printing machine is referred to as having individual impression cylinders when each of its printing units co-operates with an impression cylinder of generally reduced diameter.

Such flexographic printing machines with individual impression cylinders are frequently capable of adapting to the most varied printing conditions and particularly when the continuous material is printed recto-verso. This type of flexographic printing machine also makes it possible to conceive of beds 2 of the modular type, in which each of the modules has, as shown in FIG. 1, a front wall 5 and a rear wall 6 having support means 8 for a printing unit 1. These modules are intended to be superimposed one upon another or even juxtaposed in such a way as to give the flexographic printing machine a symmetrical structure with respect to a vertical central plane, transverse with respect to the longitudinal axis of the continuous material.

In any case, it will be noted that the present invention relates to a printing unit 1 which can be adapted both to flexographic printing machines with a sole impression cylinder or impression cylinders and having a bed of fixed dimensions or of a modular nature.

The present description of a printing unit according to the invention will apply more particularly to a flexographic printing machine with individual impression cylinders and a modular bed. However, with the aid of this description it will be easy for the expert in the art to adapt the present printing unit 1 to any type of existing model of flexographic printing machine.

Thus the printing unit 1 which is the subject of the present invention has, as is known, a plate cylinder 9 co-operating with an impression cylinder 10 and supporting all of the plates which are to be applied to the continuous material to be printed. In fact, the latter passes between the impression cylinder 10 and the plate cylinder 9.

The latter also co-operates with an inking cylinder 11 which is juxtaposed to it and generally arranged so that it is diametrically opposed to the impression cylinder 10. The inking cylinder 11, which is very often screened, is intended to apply a quantity of ink in a predetermined dosage onto the plate cylinder 9, and for this purpose it is combined with an inking device 12, the characteristics of which are independent of the present invention.

Given that the printing unit 1 according to the invention is strictly symmetrical with respect to the longitudinal central plane of the continuous material, only the structure thereof co-operating with the front wall 3 of the bed 2 will be described in detail.

Thus, the plate cylinder 9 is mounted on a shaft 13 having its ends 14 pivotably mounted in bearings 15. The latter are integral with a support 16 which is slidably mounted on the bed 2 of the flexographic printing machine. Contrary to the usual practice, this support 16 does not rest on a plane rectilinear slide arranged on the front wall 3 or rear wall 4 of the bed 2, but according to the invention it is mounted on a shaft 17 which is fixed integrally at its ends 18 and 19 to the said front wall 3 or rear wall 4 of the bed 2 parallel to the longitudinal axis of the continuous material to be printed.

The advantage offered by such a guide shaft 17 by contrast with a plane rectilinear slide resides essentially in the fact that it is easier to use and therefore less burdensome, and it gives a substantially greater precision in guiding.

Naturally, the diameter of this guide shaft 17 will be determined in such a way as to avoid any buckling under the effect of the weight of the plate cylinder 9 and the inking cylinder 11. However, in order to substantially relieve the weight for example of the plate cylinder 9, the support 16 which is associated therewith can rest in its lower part 20 on a guide ramp 21 arranged under the guide shaft 17.

Just like the plate cylinder 9, the inking cylinder is mounted on a shaft 22, the ends 23 of which are engaged in bearings 24 which are integral with a support 25 which is also slidably mounted on the guide shaft 17. The inking device 12 which applies the ink to the inking cylinder 11 is also mounted on this support 25.

Always with the aim of avoiding any deformation of the guide shaft 17 and thus to guarantee a certain precision and quality of printing, this support 25 co-operating with the inking cylinder can have on its lower face 26 a shoe 27 which optionally rests on a guide ramp 28 situated in the extension of the guide ramp 21 on the front wall 3, 5 or rear wall 4, 6 of the bed 2 or of one of the modules constituting the latter.

It will be noted that another advantage provided by the arrangement adopted within the framework of the present invention resides in the fact that the guiding both of the support 16 of the plate cylinder 9 and the support 25 of the inking cylinder 11 is limited to one single guide shaft 17. Within the scope of the prior art, the superposition of the corresponding plate cylinder support and the support associated with the inking cylinder required the provision of two plane rectilinear slides with particularly delicate machining.

Naturally, the movability conferred upon the plate cylinder 9 and the inking cylinder 11 by virtue of the sliding mounting of the supports 16 and 25 on the guide shaft 17 essentially has the purpose of permitting the disengagement of the plate cylinder 9 with respect to the impression cylinder 10 and of the inking cylinder 11 with respect to the said plate cylinder 9 in the event of stoppage of printing. Additionally, this movability permits the interchangeability of the plate cylinder 9 in order to ensure printing on a continuous material in variable formats by means of the same flexographic printing machine.

The precision in the extension of the different cylinders with respect to one another in a printing unit 1 is a determining factor in the quality of printing ensured at the level of the continuous material. Thus the printing unit includes, devices 29, 30 respectively for pre-positioning the plate cylinder 9 with respect to the impression cylinder 10 and the inking cylinder 11 with respect to the said plate cylinder 9, and, fine adjustment means 31, 32 for these same cylinders 9, 10, 11 with respect to one another.

The pre-positioning devices 29, 30 preferably consist of format blocks 33, 34 which are interposed between the support 16 for the plate cylinder 9 and a stop 35 arranged at the end 18 of the guide shaft 17 located on the same side as the impression cylinder 10, and between the said support 16 and the support 25 for the inking cylinder 11. The length of these format blocks 33, 34 is determined as a function of the printing format, and thus of the diameter of the plate cylinder 9.

The printing unit 1 also includes means for controlling the rapid approach and disengagement of the different cylinders 9, 10 and 11 with respect to one another. These rapid approach and disengagement means 36 advantageously consist of a jack 37 the body 38 of which is of the movable type and consists of the support 25, whilst the piston 39 is mounted fixed on the guide shaft 17.

Figure 2:
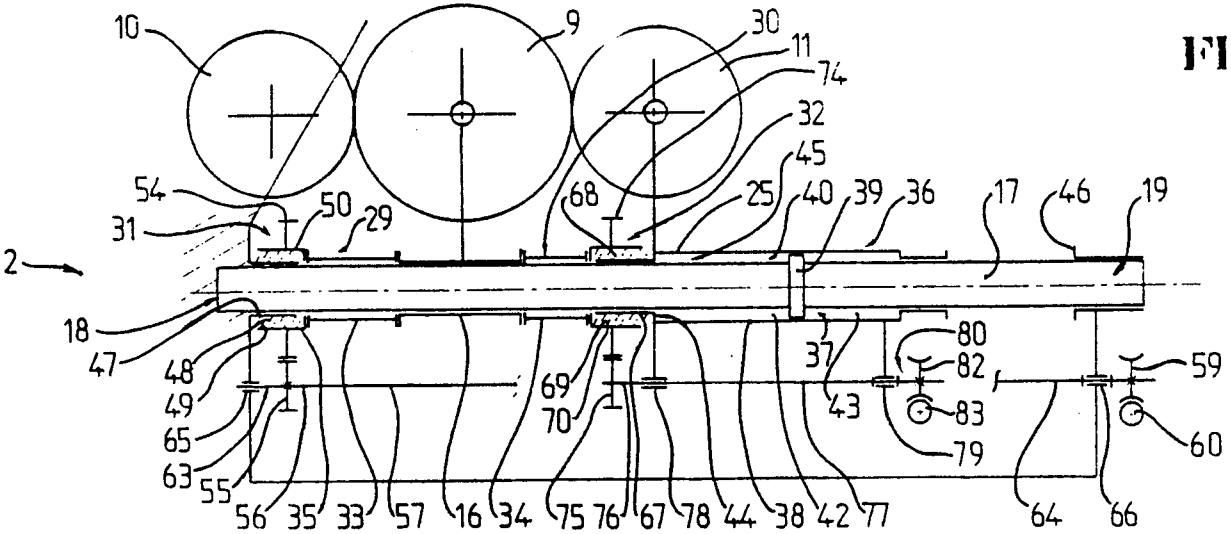
FIG. 2 shows schematically the pre-positioning devices and the fine adjustment means which act on the plate cylinder and the inking cylinder in order to position these latter with respect to the impression cylinder.
Figure 3:
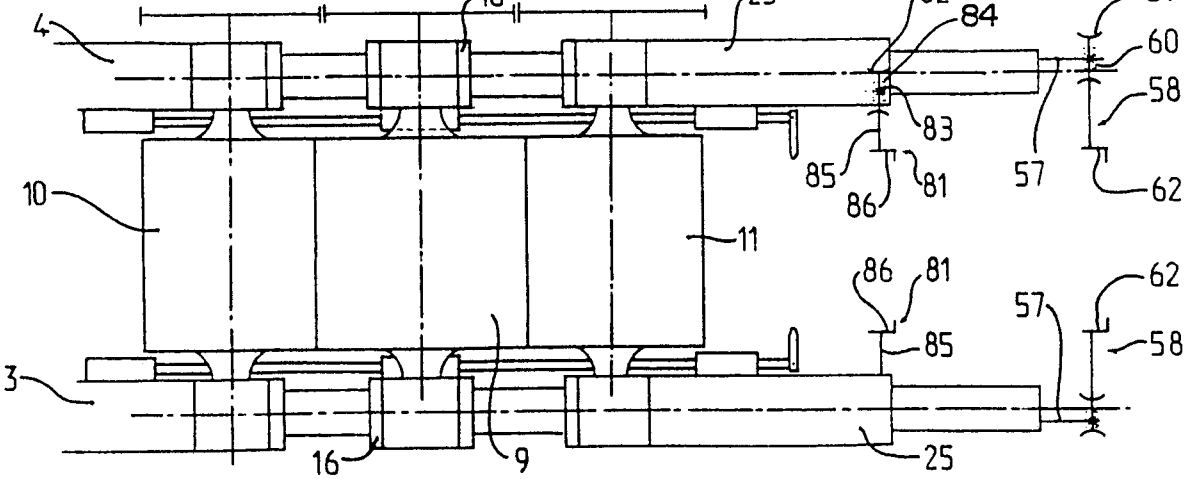
FIG. 3 shows a plan view of FIG. 2 in which are shown the driving means for the different cylinders constituting a printing unit according to the invention.
Figure 4:
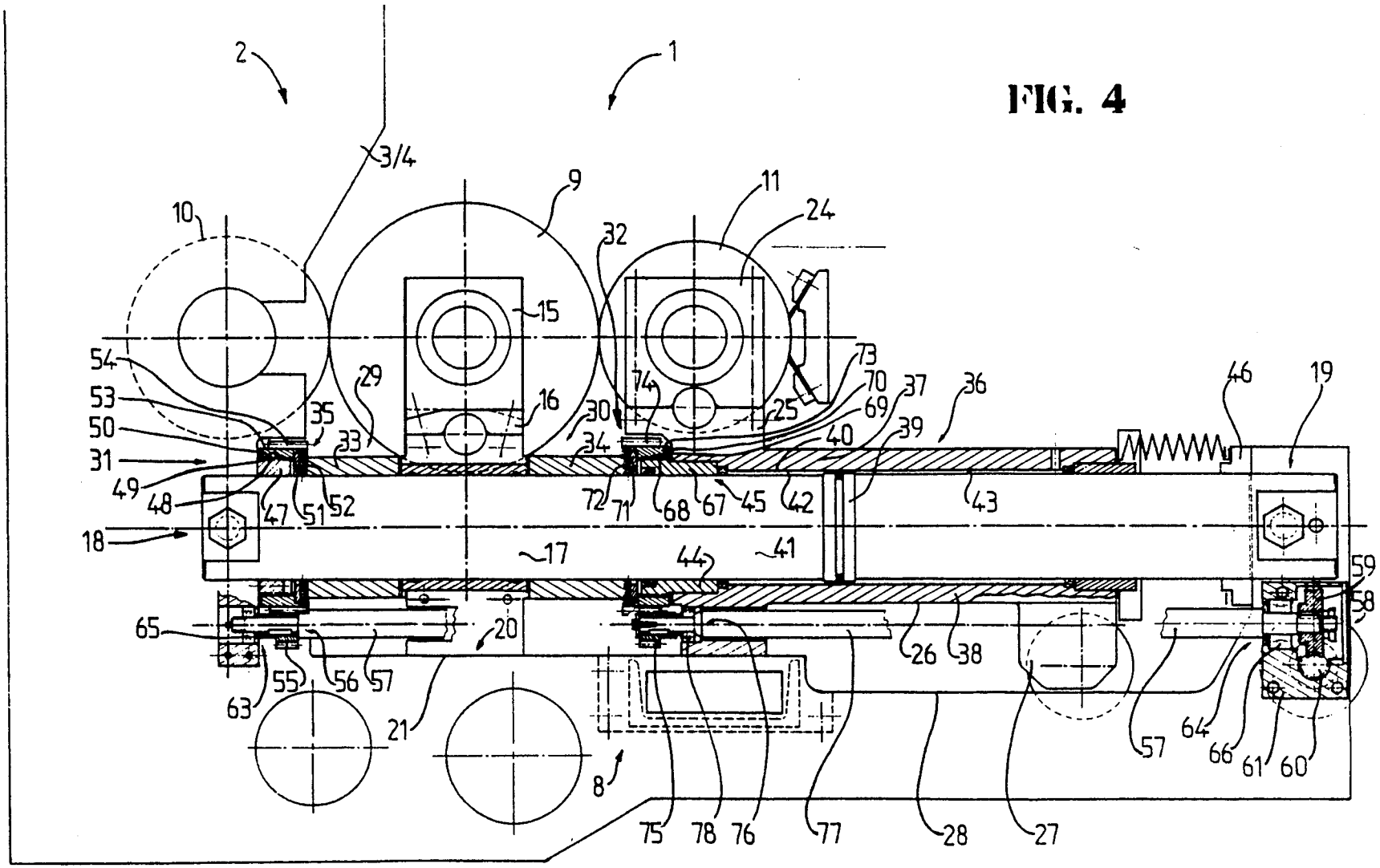
FIG. 4 shows a view in elevation and in partial section of a preferred embodiment of the fine adjustment means and of the devices for pre-positioning a plate cylinder and an inking cylinder.
Figure 5:
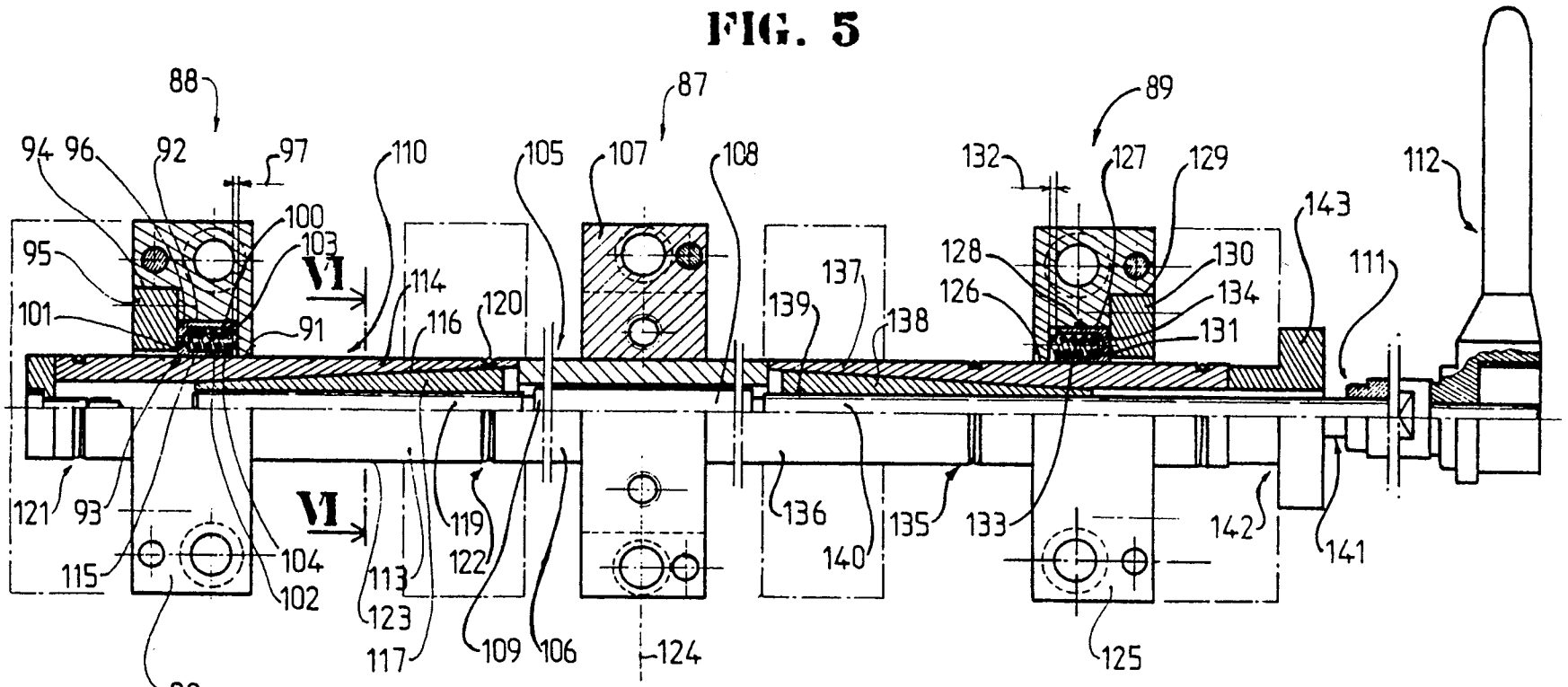
FIG. 5 shows schematically, in partial section and according to a first embodiment, the mechanical memorization means for limiting the recoil course of the different cylinders, namely the plate and inking cylinders, with respect to the impression cylinder, during interruptions of printing.
Figure 6:
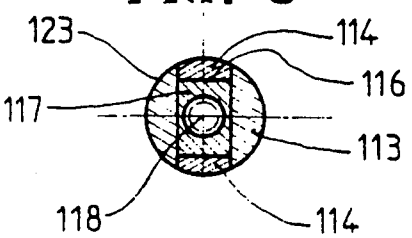
FIG. 6 shows a sectional view along the line VI—VI in FIG. 5.

FIGS. 2 and 4 illustrate respectively, schematically and in detail, means for controlling rapid approach and disengagement 36 formed by a jack 37. It may also be noted that the support 25 of the inking cylinder 11 has a cylindrical recess 40 which has the guide shaft 17 passing right through it and a diameter 41 substantially greater than the latter. The piston 39 which is fixed on the guide shaft 17 sub-divides the cylindrical recess 40 into two chambers 42, 43 between which a fluid is conveyed in such a way as to ensure, as the case may be, the approach of the different cylinders with respect to one another or their disengagement in the event of stoppage of printing. More precisely, these control means for rapid approach and disengagement 36 function as follows:

When it is desired to bring the different cylinders into contact with one another in order to commence printing of a continuous material, the laminating fluid is introduced into the chamber 42 defined by the piston 39. A closure cap 44 seals the cylindrical recess 40 at the end 45 thereof oriented towards the impression cylinder 10, and the support 25 for the inking cylinder 11 then slides along the guide shaft 17 so as to cooperate with the format block 34, the latter pushing the plate support 15 so that it is applied against the format block 33 which is immobilised by the stop 35.

By contrast, in the case of injection of the laminating fluid into the chamber 43, the support 25 for the inking cylinder 11 moves back until it reaches the rear stop 46 situated at the end 19 of the guide shaft 17. In the course of this progression and beyond a predetermined course length the support 25 for the inking cylinder 11 causes the entrainment, by means of a mechanical connection as described below, of the support 16 with which the plate cylinder 9 is associated. Thus it will be noted that sole driving means are sufficient to cause the movement forwards or back of both the plate cylinder 9 and the inking cylinder 11.

In view of the foregoing description, it should also be noted that the control means for rapid approach and disengagement 36 also constitute means for wedging the plate cylinder 9 and the inking cylinder 11 in the printing position. In fact, it is sufficient to keep a certain pressure of the laminating fluid in the chamber 42 of the jack 37 in order to maintain the stop 18, the format block 33, the support 16, the format block 34 and the support 25 simultaneously in contact with one another. This constitutes a certain advantage since it is no longer necessary to have recourse to supplementary wedging means. Thus the complexity of the mechanism of a printing unit 1 is reduced.

The means 31 for fine adjustment of the plate cylinder 9 with respect to the impressions cylinder 10 consist of the adjustable stop 35 which is mounted on the end 18 of the guide shaft 17. In fact, this stop 35 is formed by a cylindrical ferrule 47 which is integral with the front wall 3 or the rear wall 4 of the bed 2 having on its external periphery a fine thread 48 co-operating with a thread 49 machined in the bore of a bush 50. The latter is capable of pivoting by virtue of a ball thrust bearing 51 interposed between the said bush 50 and the front edge 52 of the format block 33.

The bush 50 also has on its outer periphery 53 teeth 54 which co-operate with a pinion 55 mounted on the end 56 of a transmission shaft 57. This latter extends parallel to the guide shaft 17, substantially as far as the level of the end 19 thereof and co-operates with manual or automatic control means 58.

According to the preferred embodiment shown in the drawings, this transmission shaft 57 has at its free end a pinion 59 which engages an endless screw 60 which is mounted so as to be freely rotatable in a housing 61 integral with the front or rear wall 3, 4 of the bed 2. The endless screw 60 is driven in rotation either manually by means of an easily accessible flywheel 62 or by means of appropriate driving elements.

Thus, actuation of the said flywheel in one or the other direction simultaneously causes the rotation of the bush 50 and its translation on the cylindrical ferrule 47. This results in the forward or backward movement of one of the supports 16 situated on the ends 14 of the plate cylinder 9. The fine thread 48 machined on the cylindrical ferrule 47 ensures the precise adjustment on which the quality of printing depends.

It will also be noted that the transmission shaft 57 in free rotation is held at its ends 63, 64 in bearings 65, 66 provided in the front wall 3 or rear wall 4 of the bed 2.

The means 32 for adjusting the inking cylinder 11 with respect to the plate cylinder 9 are similar to the fine adjustment means 31 described above. The closure cap 44 is extended in its external part by a cylindrical ferrule 67 equipped on its outer periphery with a fine thread 68 co-operating with a thread 69 machined at an equivalent pitch in the bore of a bush 70. This bush is held pivotably with respect to the axis of the guide shaft 17 by virtue of a ball thrust bearing 71 interposed between the said bush 70 and the front edge 72 of the format block 34.

The bush 70 also has on its outer periphery 73 teeth 74 intended to co-operate with a pinion 75 mounted at the end 76 of a transmission shaft 77 arranged parallel and beneath the guide shaft 17. This transmission shaft 77 is preferably mounted on bearings 78, 79 which are integral with the support 25 for the inking cylinder 11. The transmission means also has manual or automatic control means 81 at its opposite end 80. Within the scope of the embodiment shown in the drawings, these control means 81 are composed of a pinion 82 mounted at the end 80 of this transmission shaft 77 and co-operating with an endless screw 83 which is arranged so as to be freely rotatable in a housing 84 fixed on the said support 25 for the inking cylinder 11. From this housing 84 emerges a spindle 85 which co-operates at one end with the said endless screw 83 and has on its outer end a maneuvering flywheel 86.

It is obvious that because of the movability of the inking cylinder 11 the fine adjustment means 32 are totally associated therewith and not dependent upon the bed 2.

As with the fine adjustment means 31, the driving in rotation of the maneuvering flywheel 86 causes the rotation of the bush 70 and, simultaneously, the translation of this latter to the cylindrical ferrule 67. The bush 70, co-operating by means of the ball thrust bearing 71 with the format block 34, causes forwards or backward movement of the inking cylinder 11 with respect to the plate cylinder 9.

As discussed above, the pre-positioning devices 29, 30 and the fine adjustment means 31, 32 are located on either side of the printing unit 1 in such a way as to be able to influence the parallelism of the different cylinders 9, 10 and 11 with respect to one another.

According to the invention, the printing unit 1 also has mechanical means 87 to limit the course of the backward movement of the plate cylinder 9 with respect to the impression cylinder and of the inking cylinder 11 with respect to the plate cylinder 9.

In fact, these mechanical means 87 consist of stop means 88, 89 which are capable of limiting the extent of the displacement of the plate cylinder 9 with respect to the impression cylinder 10, and of the inking cylinder 11 with respect to the plate cylinder 9, on the command to cease printing temporarily. This limitation avoids the disengagement of the pinions driving the cylinders.

More precisely, and according to a first embodiment, the stop means 88 serving to limit the course of the backward movement of the plate cylinder 9 with respect to the impression cylinder 10, consists of a stop body 90 which is integral with the front or rear wall 3, 4 of the bed 2 substantially in the same vertical plane as the end 18 of the guide shaft 17. This stop body 90 has a central bore 91 having a first set back part 92 which serves as a seat for the means 93 capable of limiting the displacement of one of the supports 16 for the plate cylinder 9 on the guide shaft 17. A second set back part 94 of larger diameter machined in the central bore 91 permits the introduction of a retaining ring 95 which keeps the means 93 at the level of the set back part 92.

As regards more precisely the means 93, these consist of an elastic return ring 96 which is capable of being displaced axially within the set back part 92 on a predetermined course 97.

In fact, the thickness of the elastic return ring 96 is reduced by the length of the course 97 with respect to the depth of the set back part 92 machined in the central bore 91.

Furthermore, elastic return means 100 formed for example by helical springs keep the elastic return ring 96 butting against the internal face 101 of the retaining ring 95. According to a preferred embodiment, these elastic means 100 or helical springs are introduced into blind holes 102 provided on the rear face 103 of the elastic return ring 96 and co-operating with the shoulder 104 defined between the set back part 92 and the central bore 91.

By immobilising one of the supports 16 for the plate cylinder 9 with respect to the elastic return ring 96, notably when the plate cylinder 9 is in the printing position, the said support 16 would only be capable of being displaced over a length equivalent to the course 97 at the moment of being temporarily put out of printing operation. The return to the printing position is achieved in this case by the simple fact of the action of the jack 37 causing the support 16 to move forward until the elastic return ring 96 comes to butt against the internal face 101 of the retaining ring 95.

However, it will be understood that the position of the elastic return ring 96 with respect to one of the supports of the plate cylinder 9 cannot be fixed, in particular because of the variable printing formats and because a certain degree of freedom has to be conferred upon the support 16 at the time of the different rapid disengagements or approaches or even fine adjustments of the plate cylinder 9 with respect to the impression cylinder 10. To summarize, this immovability of the elastic return ring 96 with respect to the said support 16 can only be obtained at the moment when all the adjustments of the plate cylinder 9 with respect to the impression cylinder 10 have been effected.

This is made possible by the transmission means 105. These transmission means 105 are composed of a central tubular spindle 106 which is parallel to the guide shaft 17 and made integral with one of the supports 16 of the plate cylinder 9 by connecting means 107. This tubular spindle 106 has passing through it a shaft 108 which cooperates at one of its ends 109 with locking means 110 located in the axial extension of the tubular spindle 106 and capable of acting upon the elastic return ring 96. In addition, at its opposite end 111 this shaft 108 has motorized or manual means 112 for driving in rotation.

More precisely, by acting on the driving means 112, the locking means 110 act in such a way that the elastic return ring 96 is rendered integral in translation with the support 16 limiting the displacement of the latter on the sole course 97.

As regards these locking means 110, they are composed of a cylindrical chuck 113 with expandable jaws 114 which are capable of co-operating with the internal bore 115 of the elastic return ring 96. In fact, the cylindrical chuck 113 is slotted in its length in such a way as to receive the expandable jaws 114, the latter cooperating in the internal part 116 with a locking element in the form of a wedge 117. Also, by causing the locking element in the form of a wedge 117 to move forwards, under the expandable jaws 114, the latter are distanced from the central spindle 118 of the cylindrical chuck 113, eliminating the clearance existing between this latter and the said elastic return ring 96.

The locking element in the form of a wedge 117 is engaged or withdrawn by virtue of the presence of a threaded opening and co-operating with a threaded ferrule 119 situated in the extension and at the end 109 of the shaft 108.

It will be noted that the return to the withdrawn position of the expandable jaws 114 is obtained with the aid of circlips 120 of an elastic nature enclosing the cylindrical chuck 113 at its ends 121 and 122.

With the aid of the above description, it will be understood that these mechanical means 87 to limit the course of backwards movement of the plate cylinder 9 with respect to the impression cylinder 10 and, more precisely, of the stop means 88, function in the following manner:

Once the plate cylinder 9 is perfectly positioned with respect to the impression cylinder 10, the operator actuates the manual or motorized means 112 for driving in rotation causing the rotation of the shaft 108 in the tubular spindle 106 and, finally, the translation of the locking element in the form of a wedge 117 on the threaded ferrule 119, resulting in the immobilization of the elastic return ring 96 with respect to the cylindrical chuck 113 which is directly situated in the axial extension of the tubular spindle 106 and, consequently, integral in translation with the spindle;

By actuating the jack 37 to cause the inking cylinder 11 and the plate cylinder 9 to move back, the plate cylinder will be limited to the course 97 of the elastic return ring 96 in the stop body 90;

In the event of a command to unlock and interrupt printing, the rotating control of the shaft 108 in the opposite direction causes the withdrawal of the locking element in the form of a wedge 117 and, finally, the effacement of the expandable jaws 114 with respect to the external periphery 123 of the cylindrical chuck 113. The support 16 of the plate cylinder 9 is thus disengaged from the elastic return ring 96. Whatever the position occupied by the latter at this moment, the elastic means 100 cause it to return to butt against the internal face 101 of the retaining ring 95. This systematic positioning of the elastic return ring 96 with respect to a reference surface is imperative in order to guarantee a course of backward movement of the plate cylinder 9.

As regards the stop means 89, which form the mechanical means 87 to limit the course of backward movement of the inking cylinder 11 with respect to the plate cylinder 9, these means assume an identical configuration to the stop means 88 and are, in fact, symmetrical with them with respect to a vertical central plane 124 passing through the connecting means 107 which connect the tubular spindle 106 to the support 16. Thus these stop means 89 are interposed between the manual or motorized means 112 for driving in rotation which are referred to above and the end 111 of the shaft 108 located in the tubular spindle 106.

More precisely, the stop means 89 are composed of a stop body 125 which is made integral in this case with a support 25 of the inking cylinder 11 and having a central bore 126. In the central bore are provided a first set back part 127 which serves as a seat for means 128 capable of limiting the displacement of the inking cylinder 11 with respect to the plate cylinder 9 and a second set back part 129 which receives a retaining ring 130. Just as before, the means 128 consist of an elastic return ring 131 which is movable in translation following a course 132 in the set back part 127 defined within the central bore 126. Elastic means or helical springs 133 hold the elastic return ring 131 against the internal face 134 of the retaining ring 130.

The symmetrical arrangement of these stop means 89 with respect to the stop means 88 described above is essentially due to the fact that, the stop body 125 is caused to be displaced with respect to the said elastic return ring 131. The return ring is, in effect, immobilised in translation with respect to locking means 135 which co-operate with the transmissions means 105 connected to the support 16 of the plate cylinder 9.

The locking means 135 consist of a chuck 136 slotted in its length in such a way as to receive expandable jaws 137 which co-operate with a locking element in the form of a wedge 138. The latter is provided with a threaded bore through which passes a threaded ferrule 140 which extends the shaft 108 at its end 111. This threaded ferrule 140 is provided at its free end 141 with manual or motorized means 112 for driving in rotation.

Because of the symmetrical arrangement of the stop means 88 with respect to the stop means 89, the threads machined on the threaded ferrules 119 and 140 are necessarily in opposite directions so that driving of the shaft 108 causes the effacement or the engagement, simultaneously, of the locking elements in the form of wedges 117 and 138 under the expandable jaws 114 and 137.

Thus, once the different cylinders 9, 10 and 11 have been positioned with respect to one another by means of the pre-positioning devices 29, 30 or the fine adjustment means 31, 32, the control of the manual or motorized means 112 for driving in rotation 9 is commenced, causing the immobilization of the elastic return rings 96 and 131 on their cylindrical chucks 113 and 136 respectively. Because the latter are directly connected to the transmission means 105 which are integral with the support 16 for the plate cylinder 9, there is a close connection between the front or rear wall 3, 4 of the bed 2 and the support 16, on the one hand, and between the latter and the support 25 of the inking cylinder 11, on the other hand.

In fact, the control of the jack 37 by the injection of laminating fluid into the chamber 43 initially causes the movement back of the said support 25 of the inking cylinder 11 following a course 132 defined by the clearance existing between the stop body 125 and the elastic return ring 131. Beyond this course 132, the close co-operation of the said stop body 125 and the said elastic return ring 131 produces a traction on the cylindrical chuck 136 with repercussions on the tubular spindle 106 which is integral with the support 16 corresponding to the plate cylinder 9. Finally, the latter becomes effaced with respect to the impression cylinder 10 by executing a course 97 equivalent to the clearance existing between the elastic return ring 96 and the shoulder 104 defined in the stop body 90 of the stop means 88.

By contrast, the injection of laminating fluid into the chamber 42 of the jack 37 causes the return to the printing position, on the one hand, of the inking cylinder 11 with respect to the plate cylinder 9, then of the latter with respect to the impression cylinder 10, a position corresponding to the elastic return rings 96 and 131 coming into abutment against the internal faces 101 and 134 of the retaining rings 95 and 130 respectively.

Advantageously such means for mechanical memorization 87 of the printing position of the different cylinders 9 to 11 with respect to one another can also constitute the mechanical connection to which reference was made previously in the description and which makes it possible to control the displacement both of the support 16 of the plate cylinder 9 and of the support 25 corresponding to the inking cylinder 11 through the intermediary of the sole driving means.

For this purpose the cylindrical chuck 136 is provided at its free end 142 with a peripheral rim 143 against which the stop body 125 comes to rest in the event of control of the disengagement of the inking cylinder 11, simultaneously causing driving of the support 16 and thus the movement back of the plate cylinder 9 with respect to the impression cylinder 10.

Figure 7:
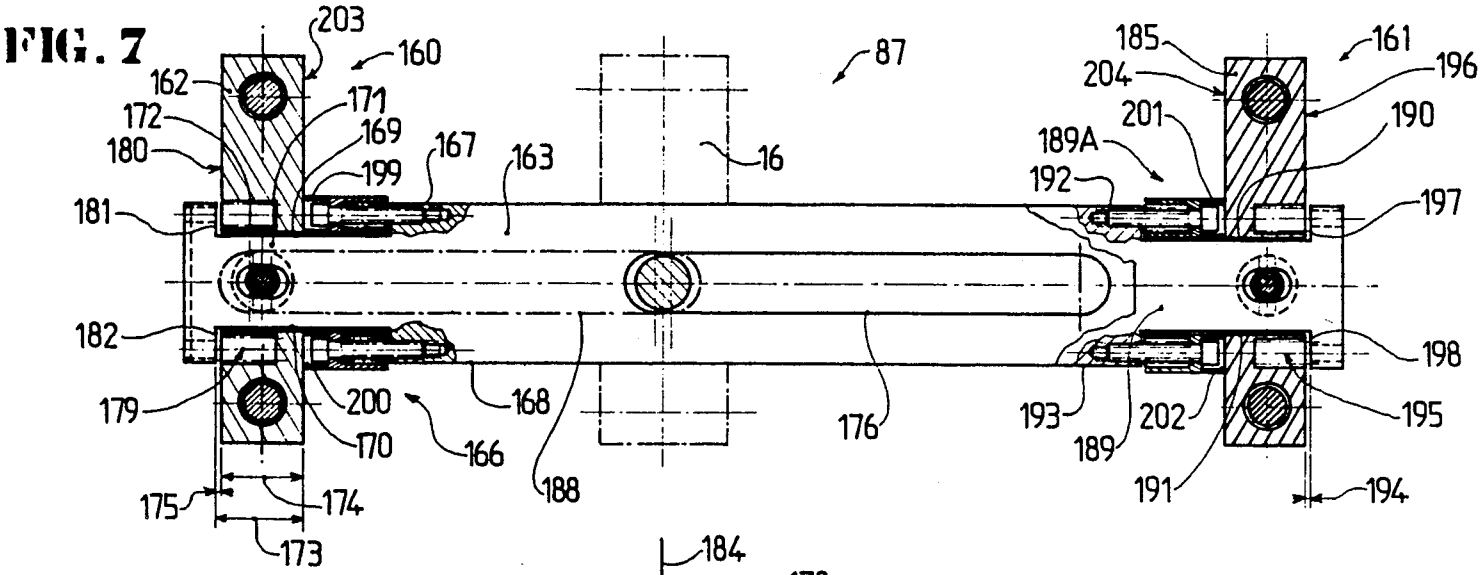
FIG. 7 shows schematically, in partial section and according to a second embodiment, the said mechanical memorization means.
Figure 8:
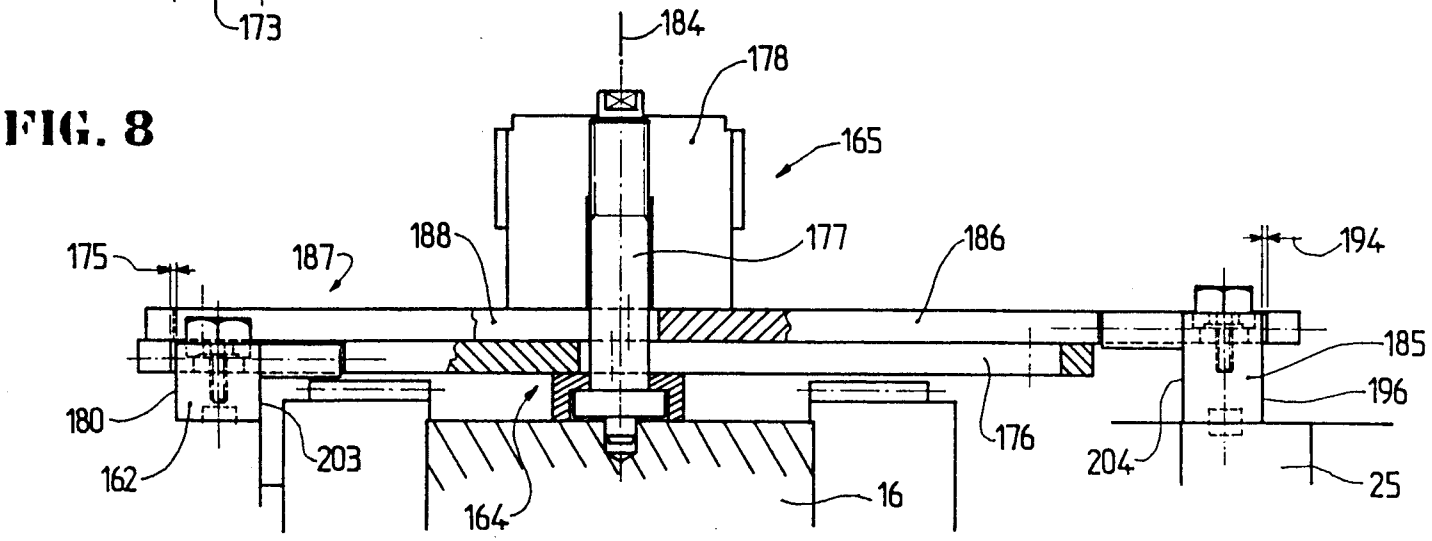
FIG. 8 shows schematically, in partial section and in elevation, the mechanical memorization means such as are illustrated in FIG. 7.

FIGS. 7 and 8 illustrate a second embodiment of these means 87 for mechanical memorization of the printing position of the plate cylinder 9 and the inking cylinder 11 with respect to one another.

In fact, and just as before, the said mechanical means 87 consist of stop means 160, 161 which are capable of limiting the extent of the displacement of the plate cylinder 9 with respect to the impression cylinder 10 and of the inking cylinder 11 with respect to the plate cylinder 9 at the moment of temporary stoppage of printing.

Given that the impression cylinder 10 is immobile with respect to the bed 2 of the flexographic printing machine, the stop means 160 are intended to limit the extent of the displacement of the plate cylinder 9 on this bed 2.

More precisely, the said stop means 160 consist according to this second embodiment of a stop 162 which is integral with the front or rear wall 3, 4 of the said bed 2 and is located substantially in the same vertical plane as the end 18 of the guide shaft 17. In addition, the said stop means 160 have a transmission rod 163 which is capable of ensuring the co-operation of the supports 16 of the plate cylinder 9 with the said stop 162 arranged on the bed 2.

In fact, the said transmission rod 163 is integral, at the level of one of its ends 164 and with the aid of connecting means 165 with the said support 16 of the plate cylinder 9. As to the other end 166 of this transmission rod 163, it has in its lateral edges 167 and 168 a set back part 169, 170 defining a portion 171 of reduced width which fits into a groove 172 provided in the stop 162.

It should be noted that the length 173 of the set back parts 169, 170 provided in the lateral edges 167, 168 of the said transmission rod 163 is determined so that it is slightly greater than the thickness 174 of the stop 162 in such a way that the said rod 163 and consequently the support 15 for the plate cylinder 9 are capable of being displaced with respect to the stop 162 on a limited course 175 when printing is stopped temporarily.

Quite obviously, and because of the variable printing formats, the connection between the transmission rod 163 and the support 16 for the plate cylinder 9 cannot be fixed. Also, by way of connection means 165, it is recommended to provide in the end 164 of the transmission rod 163 an oblong slot 176 through which passes a fixing rod 177 which is integral with the said support 16 for the plate cylinder 9. It should be noted that a jack 178, which is capable of causing locking and, finally, immobilizing the transmission rod 163 with respect to the said support 16, acts on this fixing rod 177. The presence of a hydraulic circuit on the flexographic printing machine to control the displacement of the different cylinders 9 and 11 also justifies the use of this jack 178 at the level of the connecting means 165 connecting the support 16 for the plate cylinder 9 to the said transmission rod 163.

It will be noted that in the course of the different adjustments of the positioning of the plate cylinder 9 with respect to the impression cylinder, this transmission rod 163 must be immobilized in translation with respect to the stop 162 arranged on the bed 2 in such a way that after locking of the jack 178 good positioning of this transmission rod 163 with respect to the stop 162 is ensured in such a way as to permit displacement over a course 175 of the plate cylinder 9 with respect to the impression cylinder 10.

For this purpose, elastic return means 179, consisting of helical springs inserted in blind holes provided on the front face 180 of the stop 162 and coming into cooperation with the shoulders 181, 182 defined at the end 166 of the transmission rod 163, continually push the latter forwards with respect to the stop 162.

As to the stop means 161 which are capable of limiting the extend of the displacement of the inking cylinder 11 with respect to the plate cylinder 9, these assume a substantially symmetrical configuration with respect to a vertical central plane passing through the fixing rod 177.

Thus, the means 161 are composed of a stop 185 arranged on a support 25 of the inking cylinder 11 and coming into co-operation with a transmission rod 186. More precisely, the latter has at the level of one of its ends 187 an oblong slot 188 which serves as a passage for the fixing rod 177, the other end 189A of this transmission rod 196 having a portion of reduced width 189 defined by set back parts 190, 191 provided on the lateral edges 192, 193.

The transmission rod 186 is capable of being displaced with respect to the stop 185 along a course 194 defined by the difference in length of the set back parts 190, 191 provided in the said lateral edges 192, 193 and the thickness of the stop 185. Equally, elastic return means 195 consisting of helical springs inserted in blind holes provided on the rear face 196 of the stop 185 and coming into co-operation with the defined shoulders 197, 198 at the level of the end 189A of the transmission rod 186, keep this latter in a position offset towards the rear with respect to the said stop 185.

Thus, once the different cylinders 9, 10 and 11 have been positioned with respect to one another by means of the pre-positioning devices 29, 30 or the fine adjustment means 31, 32, the jack 178 is actuated so as to join the transmission rods 163 and 186 of the support 16 of the plate cylinder 9.

For this reason, the control of the jack 37 by injection of laminating fluid into the chamber 43 initially causes the support 25 of the inking cylinder 11 to move back along a course 194 defined by the clearance existing between the stop 185 and the shoulders 197, 198 provided at the level of the end 189A of the transmission rod 186.

Beyond this course 194, the close co-operation between the said stop 185 and the transmission rod 186 produces a traction on the support 16 of the plate cylinder 9, the latter coming to be displaced on a course 175 corresponding to the clearances existing between the stop 162 and the shoulders 181, 182 defined at the end 166 of the transmission rod 163.

By contrast, the injection of the laminating fluid into the chamber 42 of the jack 37 causes the return to the printing position of, on the one hand, the inking cylinder with respect to the plate cylinder 9 then of this latter with respect to the impression cylinder 10, a position corresponding to the shoulders 199, 200 and 201, 202 defined respectively at the level of the transmission rod 163 and of the transmission rod 186 coming into abutment with the rear face 203 or the front face 204 respectively of the stop 162 arranged on the bed 2 and of the stop 185 which is integral with the support 25 of the inking cylinder 11.

Naturally, as already referred to above in the description, the structure of the printing unit 1 is strictly symmetrical with respect to the longitudinal central plane of the continuous material to be printed and, for this reason, the mechanical memorisation means 86 such as are described above will be found both on the front wall 3 and on the rear wall 4 of the bed 2.

The present invention has the advantage of ensuring a perfect reproducibility of the printing position of the different cylinders with respect to one another, particularly in the case of temporary stoppage of printing of the continuous material. It will also be noted that, by contrast with what has been achieved in the past, this control of temporary stoppage of printing produces in a first time period the disengagement of the inking cylinder with respect to the plate cylinder and then the movement of the latter back from the continuous material which is held against the impression cylinder. This results in the possibility of partially drying the plate cylinder on the said continuous material due to the prior interruption of the supply of ink. As a result the maintenance and cleaning operations as well as restoration of printing are facilitated.

We claim:

1. Printing unit for a flexographic printing machine comprising:

a) a bed b) an impression cylinder c) a plate cylinder movably mounted by first means for support on said bed;

d) an inking cylinder combined with an inking device and integral with second means for support which slide on said bed;

e) said first means for support and said second means for support being arranged to slide on a guide shaft which is integral to and mounted on a side of said bed to thereby permit said plate cylinder and said inking cylinder to slide on said guide shaft;

f) pre-positioning devices for permitting rapid approach, or disengagement of said impression cylinder, said plate cylinder, and said inking cylinder with respect to each other;

g) fine adjustment means for positioning said impression cylinder, said plate cylinder and said inking cylinder precisely with respect to each other; and h) common control means mounted adjacent said guide shaft for displacement of said first means for support and said second means for support along said guide shaft to permit rapid approach and disengagement to ensure engagement and disengagement of said impression cylinder, said plate cylinder and said inking cylinder with respect to each other.

2. The printing unit according to claim 1, further including mechanical means for memorizing a printing position of said plate cylinder with respect to said impression cylinder, and of said inking cylinder with respect to said plate cylinder, and to limit the extent of displacement of said plate cylinder and said inking cylinder when printing is interrupted.

3. The printing unit according to claim 1, wherein said common control means include a jack comprising a movable body formed by said second means for support, and a piston affixed to said guide shaft.

4. The printing unit according to claim 3, wherein said second means for support further include means forming a cylindrical recess through which said guide shaft passes, said means forming a cylindrical recess having a diameter substantially greater than said guide shaft, said piston sub-dividing said means forming a cylindrical recess into two chambers between which a laminating fluid is capable of being conveyed in order to permit the approach of said impression cylinder, plate cylinder and inking cylinder with respect to each other and their disengagement in the event of stoppage of printing.

5. The printing unit according to claim 4, wherein said fine adjustment means include a cylindrical ferrule extended by a closure cap which seals said means forming a cylindrical recess of said jack at an end oriented in the direction of said impression cylinder, said cylindrical ferrule being equipped on its outer periphery with a fine thread which cooperates with a thread machined in a bore of a bush having teeth on its outer periphery which cooperate with a pinion integral with a transmission shaft arranged on said second means for support of said inking cylinder, with said transmission shaft being rotatably driven by manual or automatic control means.

6. The printing unit according to claim 1, wherein said pre-positioning device includes format blocks interposed between said first means for support of said plate cylinder and a stop positioned at an end of said guide shaft situated on a same side as the impression cylinder, and between said first means for support of said plate cylinder and said second means for support of said inking cylinder, with said format blocks having dimensions determined as a function of printing format.

7. The printing unit according to claim 5, wherein said fine adjustment means include an adjustable stop mounted at said end of said guide shaft, said adjustable stop being composed of a cylindrical ferrule integral with said bed having on its external periphery a fine thread cooperating with a thread machined in a bore of a bush having teeth on its outer periphery which act on a pinion mounted on a transmission shaft, with said pinion being rotatably driven by a manual or automatic control means.

8. The printing unit according to claim 1, further comprising mechanical means for memorizing the position at stoppage of printing of said impression cylinder, said plate cylinder and said inking cylinder with respect to each other, said mechanical means including means for stopping to limit the extent of displacement executed by said plate cylinder with respect to said impression cylinder, and by said inking cylinder with respect to said plate cylinder.

9. The printing unit according to claim 8, wherein said means for stopping include a stop body integral with said bed having a substantially vertical alignment with an end of said guide shaft, and said stop body include a central bore and a first set back part serving as a seat for means for limiting displacement of said first means for support of said plate cylinder on said guide shaft and a second set back part, of a greater diameter, permitting engagement of a retaining ring.

10. The printing unit according to claim 9, wherein said means for limiting displacement of said first means for support of said plate cylinder on said guide shaft include an elastic return ring capable of being displaced axially in an interior portion of said first set back part on a predetermined course, said elastic return ring capable of being brought into cooperation with transmission means via a means for connecting with said first means for support of said plate cylinder, to thereby limit displacement of said first means for support to an extent equal to the predetermined course.

11. The printing unit according to claim 10, wherein said transmission means include a tubular spindle which is parallel to said guide shaft and integral with said first means for support, a shaft passing through said tubular spindle, with said shaft cooperating at one of its ends with means for locking which act on said elastic return ring and are located in an axial extension of said tubular spindle, and at its other end with motorized or manual means for driving in rotation.

12. The printing unit according to claim 11, wherein said means for locking include a cylindrical chuck having slots along its length so as to receive expandable jaws which are capable of cooperating with an internal bore of said elastic return ring, a wedge-shaped locking element positioned inside said cylindrical chuck so as to actuate said expandable jaws when subjected to an axial displacement, and said wedge-shaped locking element having, at an axial extension at the end of said shaft cooperating with said means for locking, a centrally located threaded opening in which is screwed a threaded ferrule.

13. The printing unit according to claim 8, wherein said means for stopping include a stop body integral with said second means for support of said inking cylinder, said stop body having a central bore including a first set back part serving as a seat for means to limit displacement of said inking cylinder with respect to said plate cylinder, and a second set back part which receives a retaining ring.

14. The printing unit according to claim 13, wherein said means for limiting displacement of said inking cylinder with respect to said plate cylinder include an elastic return ring movable in translation following a course in said first set back part cooperating with means for locking associated with transmission means for limiting movability of said second means for support of said inking cylinder with respect to said first means for support of said plate cylinder to a course equal to that of said elastic return ring.

15. The printing unit according to claim 14, wherein said means for locking include a cylindrical chuck having slots along its length so as to receive expandable jaws which are capable of cooperating with an internal bore of said elastic return ring, a wedge-shaped element positioned inside said cylindrical chuck so as to actuate said expandable jaws, and said wedge-shaped element having a threaded bore through which passes a threaded ferrule that extends from a shaft of said transmission means, and said threaded ferrule including at a free end at least one of manual and motorized means for driving in rotation.

16. The printing unit according to claim 8, wherein said means for stopping include a stop which is integral with at least one of a front and rear wall of said bed, and located substantially in same vertical plane as an end of said guide shaft, and a transmission rod integral at one of its ends via means for connecting with said first means for support of said plate cylinder, and at its other end including, at its lateral edges, a set back part defining a portion of reduced width fitting into a groove in said stop, said set back part having a predetermined length slightly greater than the thickness of said stop so that said first means for support of said plate cylinder is capable of being displaced with respect to said stop on a limited course when printing is stopped.

17. The printing unit according to claim 16, wherein said means for connecting include a fixing rod and a jack; and said transmission rod includes, at said one end, an oblong slot through which passes said fixing rod, said fixing rod being integral with said first means for support of said plate cylinder and cooperating with said jack to immobilize said transmission rod in translation with respect to said first means for support.

18. The printing unit according to claim 16, wherein said means for stopping include means for elastic return including helical springs inserted in blind holes provided on a front face of said stop and coming into cooperation with shoulders defined at said other end of said transmission rod in order to push said transmission rod forward with respect to said stop.

19. The printing unit according to claim 18, wherein said means for stopping include a stop arranged on said second means for support of said inking cylinder, and a transmission rod having at one of its ends an oblong slot which serves as a passage for a fixing rod connected to said first means for support of said plate cylinder, said transmission rod having at its other end a portion of reduced width defined by set back parts provided on its lateral edges and having a length substantially greater than the thickness of said stop, so that said second means for support of said inking cylinder is capable of being displaced with respect to said transmission rod and also with respect to said first means for support of said plate cylinder on a limited course when printing is stopped.

20. The printing unit according to claim 19, wherein said means for stopping include elastic return means comprising helical springs inserted in blind holes on a rear face of said stop, and capable of coming into cooperation with defined shoulders at an end of said transmission rod in order to push said transmission rod rearwardly with respect to said stop.

* * * * *